US012076631B1

(12) United States Patent
Vidotto

(10) Patent No.: US 12,076,631 B1
(45) Date of Patent: Sep. 3, 2024

(54) PUTTING ALIGNMENT AID

(71) Applicant: Guido Vidotto, Davenport, FL (US)

(72) Inventor: Guido Vidotto, Davenport, FL (US)

( * ) Notice: Subject to any disclaimer, the term of this patent is extended or adjusted under 35 U.S.C. 154(b) by 0 days.

(21) Appl. No.: 18/513,526

(22) Filed: Nov. 18, 2023

(51) Int. Cl.
*A63B 69/36* (2006.01)

(52) U.S. Cl.
CPC .... *A63B 69/36213* (2020.08); *A63B 69/3608* (2013.01)

(58) Field of Classification Search
CPC ..... A63B 69/36213; A63B 69/3608
USPC ..... 473/215, 221, 222, 225, 228, 229, 257, 473/259, 260, 261
See application file for complete search history.

(56) References Cited

U.S. PATENT DOCUMENTS 3,953,035 A * 4/1976 Beckisk ..... A63B 69/3676 473/258
5,947,834 A * 9/1999 Hope ..... A63B 69/36213 473/258
7,883,429 B1 * 2/2011 Chen ..... A63B 69/36213 473/258
7,993,210 B1 * 8/2011 Hatfield ..... A63B 69/36213 473/215
8,298,094 B1 * 10/2012 Chen ..... A63B 69/3667 473/258
8,491,349 B2 * 7/2013 Steinhour ..... B63H 16/04 440/101
8,926,446 B1 * 1/2015 Jones ..... A63B 69/36211 473/258
10,974,115 B1 * 4/2021 Hatfield ..... A63B 69/3608
2012/0178545 A1 * 7/2012 Bowlby ..... A63B 69/36213 473/229
2014/0128172 A1 * 5/2014 Basile ..... A63B 69/36213 473/282
2015/0238838 A1 * 8/2015 Malamitsas ..... A63B 69/3685 473/229

* cited by examiner

*Primary Examiner* — Nini F Legesse
(74) *Attorney, Agent, or Firm* — Sam Pierce

(57) ABSTRACT

According to an aspect of the present invention, there is provided a golf putting training aid, comprising: a track; a clamp configured to attach to a putter grip; an extension from the clamp configured to run along the track; and one or more supports for the track.

11 Claims, 3 Drawing Sheets

PUTTING ALIGNMENT AID

BACKGROUND

Devices for practicing and improving the putting stroke of a golfer are known in the prior art patent literature.

For example, U.S. Pat. No. 9,586,122 describes a device for assisting and training golfers with their putts. The device includes an elongated section configured to be placed on the ground where the golfer intends to make his backswing for a selected put. A vertical section or "backstop" is configured to be placed at selected locations along the elongated section corresponding to different putt lengths, and therefore different backswing lengths. A distance scale may be printed on the elongated section. Light projection devices may be included to project a predicted ball path. A backswing speed indicator system may also be included.

US20110039629 discloses a golf putting training apparatus for use with a putter comprising: a base having a support upstanding therefrom; a guide carried by said support and having an elongate guide surface for contact with a putter shaft; and an indicator extending laterally from the base, below the guide surface, to provide a golfer with a visual indication of alignment of the face of the putter head with respect to a golf ball; whereby in use a golfer may practice a putting stroke by swinging the putter so that the shaft runs along the guide surface, whilst using the indicator to align the face of the putter head at an appropriate angle for striking a golf ball.

Nevertheless, putting remains a very difficult skill to master, and improved devices for optimizing the putting stroke of a golfer are highly desirable.

SUMMARY OF INVENTION

Therefore, the present invention is a golf training aid specifically for putting that helps the golfer achieve a correct and neutral path of the golfer's hands which eventually improves the motion of the putter head.

According to an aspect of the present invention, there is provided a golf putting training aid, comprising: a track; a clamp configured to attach to a putter grip; an extension from the clamp configured to run along the track; and one or more supports for the track.

DETAILED DESCRIPTION

Whereas prior art training aids such as putting arcs generally sit on the floor and guide the motion of the putter head, the present invention is a hand motion correction tool for golf putting.

The present invention provides an innovative tool designed to assist golfers in improving their putting technique and correcting hand movement during their stroke. The hand motion correction tool for golfers is designed to be an effective and versatile solution that will help golfers of all levels perfect their game and achieve greater success on the green.

When using this product, the golfer can address the issue of hand movement when executing a putt. The device will assist in achieving a neutral hand movement, resulting in a better clubhead motion. Its innovative design and unique features make it a valuable addition for any golfer committed to improving their putting technique.

Figure 1:
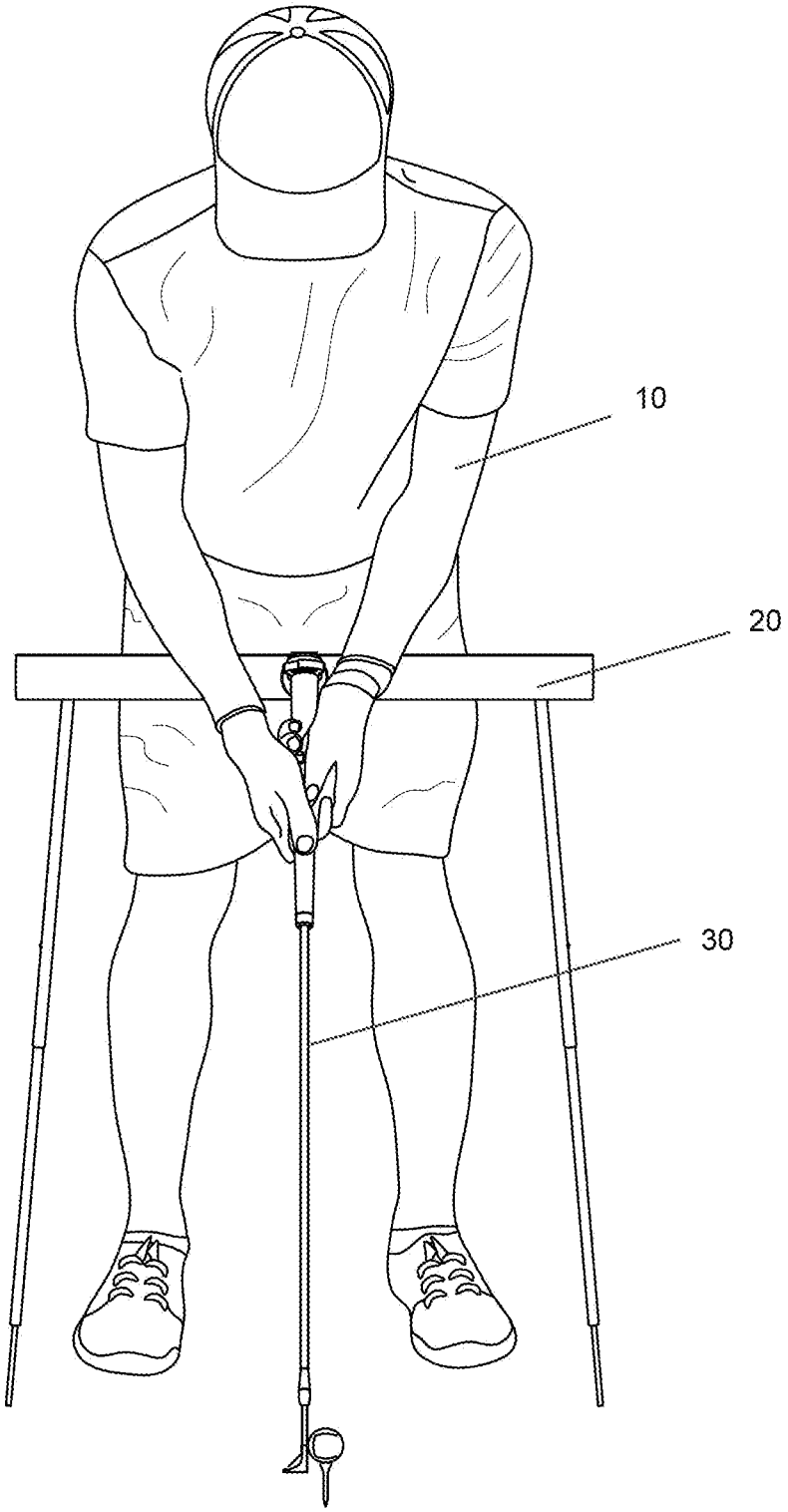
FIG. 1 illustrates a golfer using a device according to an embodiment of the present invention.

FIG. 1 illustrates a golfer using a device according to an embodiment of the present invention.

Golfer 10 holds putter 30. To use the training device according to an embodiment, golfer 10 attempts to make a putting stroke with the hands of golfer 10 while keeping putter 30 in line with putting stroke aid device 20. The attachment to putter 30 may glide along putting stroke aid device 20, hover near putting stroke aid device 20, or it may be attachable and detachable magnetically or mechanically, for example.

Figure 2:
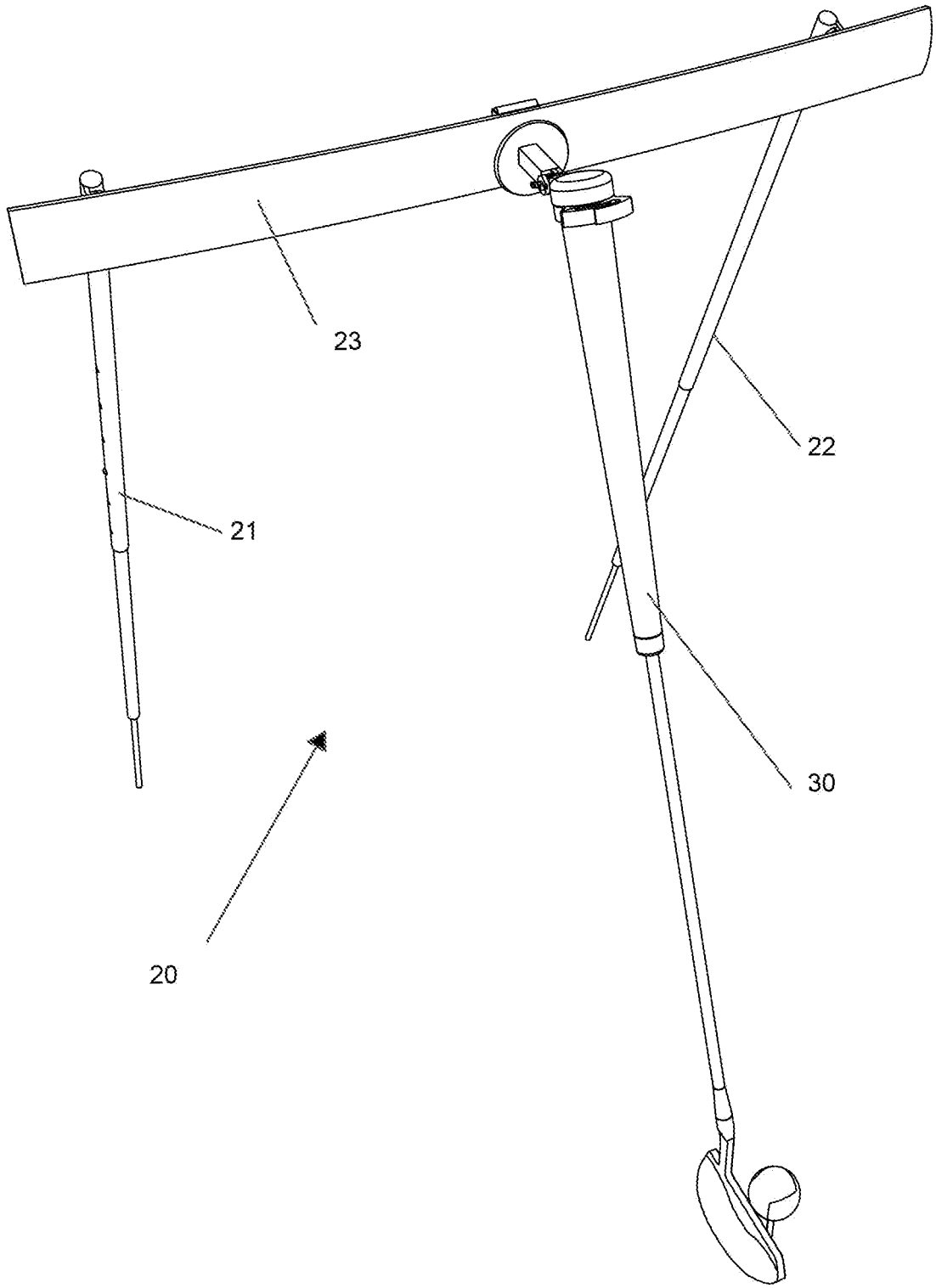
FIG. 2 illustrates the device according to an embodiment of the present invention.

FIG. 2 illustrates the device according to an embodiment of the present invention.

Putting stroke aid device 20 has supports 21 and 22. Supports 21 and 22 can be two fiberglass rods that extend toward the golfer's belt. They can firmly embed into the surface of the green. The rods can have numerical references so the golfer knows that the device matches on the right and left sides.

An attachment clamps on to snugly fit the grip of the golfer's putter 30. It can effortlessly glide along the slightly curved rectangular track 23. Both pieces can be finely adjusted to match the golfer's posture and setup.

Figure 3:
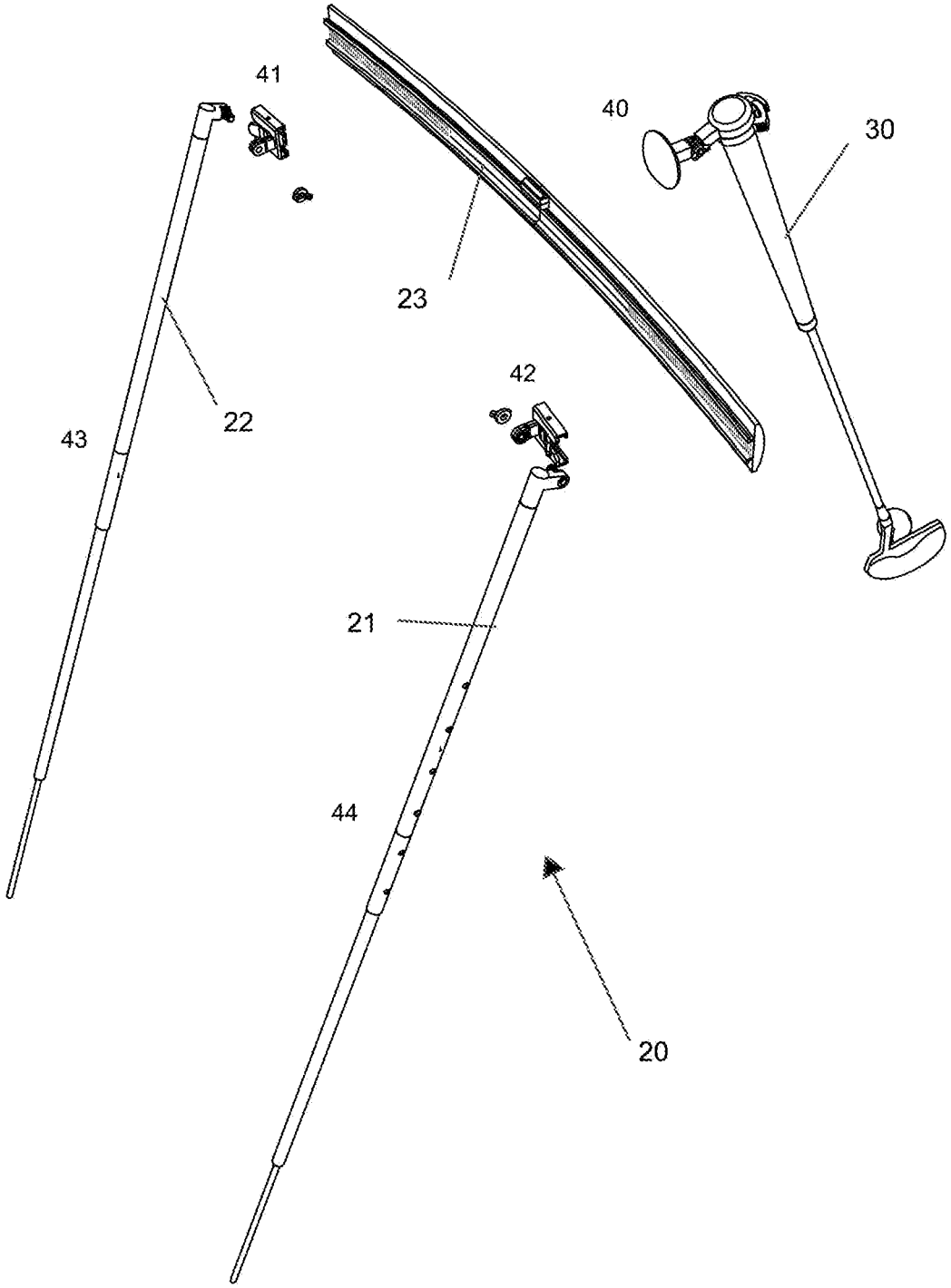
FIG. 3 illustrates the components of the device according to an embodiment of the present invention.

FIG. 3 illustrates the components of putting stroke aid device 20 according to an embodiment of the present invention.

Supports 21 and 22 can be telescoping poles to allow for adjusting the height. The support(s) can be configured to adjust the height of track 23 in order to optimize it for the height of putter 30 having an attachment which runs along track 23. The separation of supports 21 and 22 can be modulated with two adjustable components connecting the supports to the track.

In an alternate embodiment, the one or more supports attach to the belt of a golfer. Additional pieces can be provided which clip on to the belt of a golfer, and rods can connect from the track to the clip-on pieces. Two rods can connect to two clip-on pieces on each side of the golfer's waist, for example.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Similar numerals designate similar elements among the several figures. Certain proportions thereof may be exaggerated, while others may be minimized. Accordingly, the specification and drawings are to be regarded in an illustrative rather than a restrictive sense. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Therefore, it is intended that the disclosure not be limited to the particular embodiment(s) disclosed.

What is claimed is:

1. A golf putting training aid, comprising:

a track;

a clamp configured to attach to a putter grip, wherein the clamp attaches to the top end of the grip;

an extension (40) from the clamp configured to run along the track and attach to and detach from the track magnetically, wherein the extension can move translationally down the track; and two telescoping (43, 44) fiberglass rods supporting the track, wherein both supports stick into the ground; and two fittings (41, 42) attached to the telescoping fiberglass rods configured to insert on each end of the track within a grove in the track to suspend the track in the air.

2. The golf putting training aid of claim 1, wherein the track is a slightly curved rectangular shape.

3. The golf putting training aid of claim 1, wherein the clamp encircles the grip of the putter.

4. The golf putting training aid of claim 1, wherein the part of the extension from the clamp configured to run along the track is circular.

5. The golf putting training aid of claim 1, wherein the one or more supports are fiberglass rods.

6. The golf putting training aid of claim 1, wherein there are two supports for the track.

7. The golf putting training aid of claim 6, wherein both supports are configured to stick into the ground to secure the track and the supports.

8. The golf putting training aid of claim 6, wherein both supports rods have numerical references.

9. The golf putting training aid of claim 1, wherein the support(s) are configured to adjust the height of the track.

10. The golf putting training aid of claim 9, wherein the track is set to the height of the golfer's wrists.

11. The golf putting training aid of claim 1, wherein the one or more supports attach to the belt of a golfer.

* * * * *